United States Patent [19]

Schiemann

[11] Patent Number: 4,893,724

[45] Date of Patent: Jan. 16, 1990

[54] CLOSURE FOR A CANISTER

[76] Inventor: Wolfram Schiemann, Eugen-Nagele Str. 17, D-1740 Ludwigsburg, Fed. Rep. of Germany

[21] Appl. No.: 202,969

[22] Filed: Jun. 6, 1988

[51] Int. Cl.[4] ..... B65D 43/26

[52] U.S. Cl. ..... 220/263; 220/318; 220/335; 220/343; 220/344

[58] Field of Search ..... 220/263, 318, 335, 343, 220/344, DIG. 33

[56] References Cited

U.S. PATENT DOCUMENTS

| | | | |
|---|---|---|---|
| 2,329,716 | 9/1943 | Johnson | 220/343 X |
| 2,364,206 | 12/1944 | Gardes | 220/343 X |
| 4,065,024 | 12/1977 | Atwell | 220/318 X |
| 4,730,747 | 3/1988 | Schiemann | 220/263 X |

FOREIGN PATENT DOCUMENTS

| | | | |
|---|---|---|---|
| 2117318 | 10/1972 | Fed. Rep. of Germany | 220/318 |
| 2126343 | 12/1972 | Fed. Rep. of Germany | 220/318 |
| 2356222 | 5/1975 | Fed. Rep. of Germany | 220/263 |

*Primary Examiner*—Stephen Marcus
*Assistant Examiner*—Nova Stucker

[57] ABSTRACT

A closure for a plastic canister in the 20–30 liter range has a collar coaxial with a pouring spout on the canister, with side abutments with lower surfaces arranged to cooperate with the claws of the closure. A cap is arranged to swing between an open condition and a closed condition relative to the collar. The claw is approximately U-shaped, with a transverse gripping web and two longitudinal webs ending in a fork having an upper and a lower prong. The upper prongs are arranged to form a swivel hinge with journals on the cap. The lower prongs have inner surfaces arranged to cooperate with lower surfaces of the abutments such that when the gripping web is pressed downward a sealing ring in the cap is pressed onto the end face of the pouring nozzle. The collar is arranged to fit against the cap with minimal spacings and the claw is arranged to fit against the collar and the cap with minimal spacings, when the cap is in the closed condition. The spacings permit relative movement of the claw and the cap during opening and closing of the cap, and are smaller than deformations occurring as a result of impact loads on the closure.

38 Claims, 7 Drawing Sheets

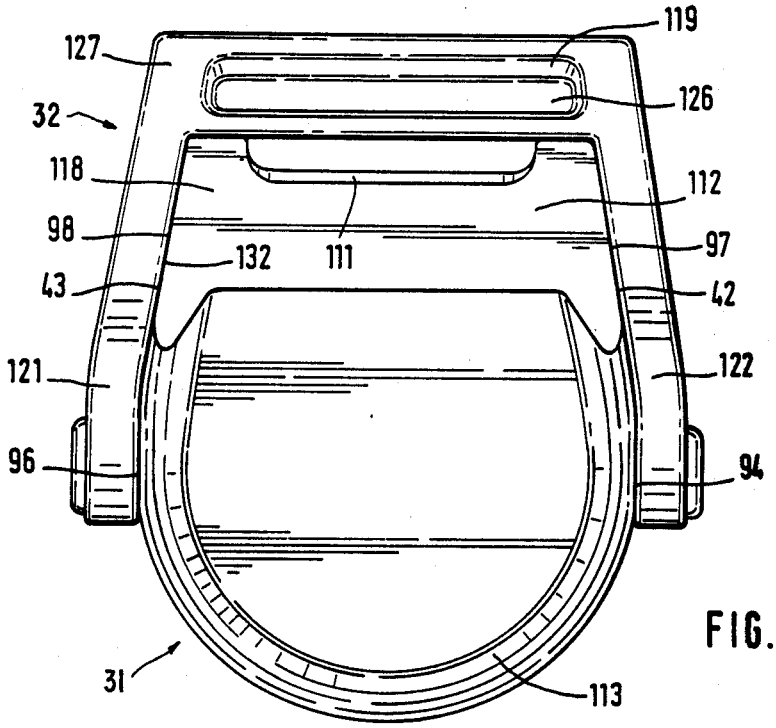
FIG. 6
FIG. 8
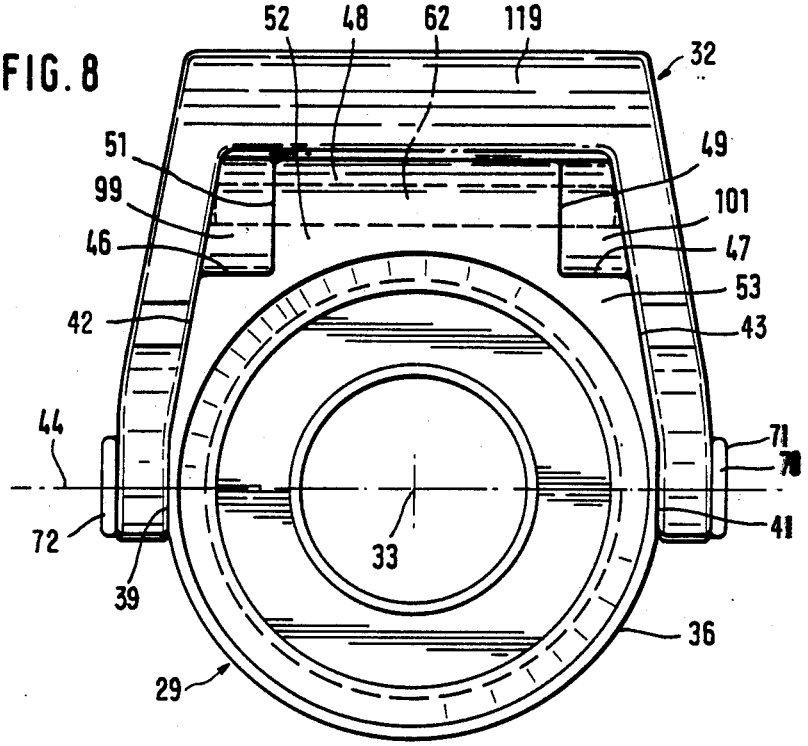

CLOSURE FOR A CANISTER

This invention relates to a claw-type closure for a plastic canister in the 20–30 liter range.

BACKGROUND OF THE INVENTION

A closure of this kind was disclosed, for example, in German patent specification No. 3,031,945. This closure from the same inventor has the following disadvantages:

(a) The canisters do not stack well because the second canister stacked on a particular canister is poorly supported in the region of the closure.

(b) The closure is made up of a large number of different parts.

(c) It is difficult to open if an attendant is wearing gloves.

(d) In practice, a safety catch prestressed by a leaf spring is necessary to ensure that the closure does not come open under adverse conditions. It is thus necessary, first of all, to undo the catch and then open the claw. If, however, in disaster situations, several hundred canisters have to be opened quickly, this means an extremely great loss of time and furthermore, that an attendant will be able to open perhaps 30 canisters but will then be lacking the strength to open further canisters.

(e) The force required to open and close the claw is great, even disregarding the leaf spring catch.

(f) In a drop test, a full canister is thrown closure-first from a height of several meters onto a concrete slab, both when the temperature is extremely low and when it is extremely high. In the case of the known closure, it is difficult to fulfill these conditions.

(g) Although the overall design of the closure makes it possible to cast the collar in metal, it is not possible in the case of this design to produce the claw and the cap by casting as well, whether in plastic or optionally metal and/or plastic.

OBJECT AND STATEMENT OF THE INVENTION

It is the object of the invention to provide a closure which overall avoids the disadvantages indicated above but nevertheless leads to a closure which is simple, can accordingly be cheap and which anyone can understand how to operate even if seeing it for the first time and which, in terms of force, can be frequently and successfully operated by even weak or weakened persons.

This object is achieved by a claw-type closure having the following features:

a collar coaxial with a pouring spout on the canister, having a rearward periphery and sides having two abutments, the abutments having lower surfaces arranged to cooperate with the claws of the closure, a cap with a sealing ring therein and lateral and rearward edge regions, the cap being arranged to swing between an open condition and a closed condition relative to the collar, a first hinge half projecting from the rearward periphery of the collar, a second hinge half on the rearward edge region of the cap that cooperates with the first hinge half, the first and second hinge halves being shaped to prevent the cap from swinging to the closed condition when the cap is in the open condition, two journals arranged on the lateral edge regions of the cap, and a claw that is approximately U-shaped, seen in plan view, with a transverse gripping web with end regions, and two longitudinal webs emanating from the end regions, each of the longitudinal webs ending at a free end in a fork having an upper and a lower prong as seen in the closed condition of the cap, each of the upper prongs being arranged to form a swivel hinge with the journals, each of the lower prongs having an inner surface arranged to cooperate with the lower surfaces of the abutments such that when the gripping web is pressed downward the sealing ring in the cap is pressed onto the end face of the pouring nozzle, the collar being arranged to fit against the cap with minimal spacings and the claw being arranged to fit against the collar and the cap with minimal spacings, when the cap is in the closed condition, the spacings permitting relative movement of the claw and the cap during opening and closing of the cap, the spacings being smaller than deformations occurring as a result of impact loads on the closure.

Advantageously, the invention includes the following additional features: The length and breadth of the closure in the closed condition are greater than 10 cm. By virtue of these dimensional minimums, it is possible to arrive at dimensions which are favorable for absorbing impact forces, are favorable for absorbing the forces encountered during stacking, and which avoid the problems which arise when dealing with small components. The parts can be of such broad dimensions that the material flows satisfactorily into the cavities provided for them in the injection molds.

The breadth is between 10 and 14 cm., and preferably in the region of 13 cm. This effect can be increased still further by virtue of these dimensions, while the size of the closure nevertheless remains within the scope of 20 to 30 liter canisters.

The length is between 12 and 16 cm., and preferably in the range of 14–15 cm. The same applies in corresponding fashion to these dimensions.

Plastic is the material of which at least one of the following is composed: the collar, the cap and the claw. The plastic is glass fiber-reinforced plastic. It is thus possible to achieve a simple and inexpensive mode of manufacture, which is nevertheless of high strength and has a long life. If highly flammable liquids are transported in the canisters, the possibility of spark generation and hence the risk of an explosion is reduced. This risk is absent when all the parts are made of plastic.

The plastic is glass fiber-reinforce polycarbonate type. The plastic is of the Zytel type (registered trademark of the DuPont Company). The plastic is of the Rynite type (registered trademark of the DuPont Company). Such plastics have proven highly suitable in tests.

The collar comprises a lower, annular, solid body that firmly surrounds the pouring nozzle, having a coaxial inner rim with an outside diameter that is substantially smaller than the outside diameter of the collar, the inner rim projecting upwards from the body, and a coaxial supporting ledge forming an end face of the body outside the inner rim, and the cap has an inside diameter that is slightly greater than the outside diameter of the inner rim of the body. These features enable the body to absorb well the radial opposing forces of the pouring nozzle, enable the closure to be of low constructional height and enable the collar to fit well against the cap.

The inner rim and the outer rim are at least approximately equal in height. By virtue of this feature the height of the closure is furthermore minimized and the surface area is increased to an optimum enabling the shear forces between the collar and the cap to be absorbed.

The cap has an upper surface and the outer rim continues as a bead for several millimeters above the upper surface. By virtue of this feature the cap is reinforced without making an over-large depression, and furthermore the probability that forces will act on the bead is then higher, and this bead can then divert these forces into the body by the shortest route.

The canister has handles with upper sides defining a stacking plane of the canister, and the bead does not extend above the stacking plane. By virtue of these features, the bead is prevented from making the stacking surface on the upper side of the cap uneven.

In the region of the hinge halves, the cap and the collar are approximately as broad as the outer diameter of the pouring nozzle. By virtue of this feature, a closure which is broad in the rearward region is achieved, this having the advantage that the forces acting on the hinge halves are widely spaced, so that these forces can be absorbed efficiently. In addition, it is then possible to make the stacking surface large.

The hinge halves comprise two solid gudgeons between which a solid hinge block is located. By virtue of this feature, hinge halves are obtained which absorb the forces efficiently and this virtually without rattling in the lateral direction.

The hinge block is provided on the collar. By virtue of this feature, the hinge block, as part of the body, reinforces the collar at this point.

The hinge block is traversed by a circular, cylindrical pin, the ends of which form a swivel axis for the gudgeons. The pin is a metal pin. By virtue of these features, it is possible to injection-mold the hinge block in a simple manner. The metal pin extends over a relatively long length and is thus able to direct its forces efficiently into the hinge block and the metal pin can furthermore absorb large forces in its critical end region.

The collar has a widened region with complimentary recesses for the gudgeons. This feature enables the two hinge halves to fit together very closely, this entailing the abovementioned advantages.

In side elevation and in the closed condition, the gudgeons have at least substantially the same profile as the hinge block. By virtue of this feature, a closure is obtained which, in the closed condition, has similar effects to those of a one-piece component.

The cap has a face on the rearward edge region, the hinge block has a rear upper region, each of the gudgeons has an approximately heart-shaped recess with a tip that points upwards, a lower heart chamber, and an upper heart chamber, a pin is arranged to lie in the lower heart chamber in the closed condition and in the upper heart chamber in the open condition, and in the open condition the face on the rearward edge region rests against the rear upper region of the hinge block. By virtue of these features, the cap is prevented in a simple manner from swinging forward during pouring, even when, for example, the central handle of the canister is absent or is too remote from the hinge region.

The claw and the cap have rear upper sides, and the canister has a stacking plane along the rear upper sides of the claw and the cap. By virtue of these features, large stacking surfaces are obtained, making the cap almost more suitable for absorbing stacking forces than the canister handles.

In the closed condition the gripping web of the claw rests on at least one of the hinge halves. By virtue of these features, an autonomous system is obtained, the parts of which fit into one another well and can absorb forces efficiently.

The canister has a central handle and two outer handles, and the gripping web extends a long way beyond the sides of the central handle towards the outer handles. By virtue of these features, the gripping web can be gripped well even with gloves and, furthermore, large bearing surfaces and favorable force conditions are obtained.

The abutments are integral with the collar and comprise prestressed downward-arched portions. By virtue of this feature, a closure of low constructional height is achieved, and the abutment in the form of a U-shaped bow which was hitherto used and presented difficulties in terms of production technolody is avoided.

The collar has a supporting ledge, each abutment has an upper side that lies approximately at the level of the supporting ledge and a lower region on the downward arched portion that lies approximately halfway up the collar body, and the lower prong has a region of engagement with the downward arched portion that is approximately equal in height to the lower half of the collar body. By virtue of these features, the abutment comes to be located relatively far up, which means that the lower prong can be relatively high, enabling the abutment and the lower prong in the optimum case to absorb forces of approximately the same magnitude.

Each lower prong has an outer surface, and each abutment has an outside with a downward-pointing guide rib for the outer surface of the lower prong. By virtue of these features, the lower prong is provided with guidance in the closed condition in the event of overloading.

Each abutment has an arched portion, and each lower prong has an upper side with a transverse groove into which the arched portion of the abutment locks when the claw is closed. The arched portion locks deeply. By virtue of these features, the closure is secured against unintentional opening. In addition, the claw in this case moves automatically into the closing position at the end of the closing movement, and finally locking is then clearly heard, the canister itself acting as a sound-amplifying drum. This acoustic check is important, in particular when a large number of canisters have to be closed when tired.

The transverse groove is spaced below and a short distance from the journal. The distance is ultra-short. By virtue of these features, the region between the upper prong and the lower prong, the region being subjected to bending stress and other forces, is reduced to a minimum and can thus absorb the forces efficiently.

In the closed condition the lower prong does not protrude beyond the journal. By virtue of this feature, a compact functional block is obtained in this region, with the result that, for example, forces acting from above cannot force the lower prong in the opening direction. In addition, a flat, self-contained unit is in this case obtained at this point, so that the parts located at this point absorb forces to an equal extent.

Each lower prong has a front end, each abutmment has a front edge, and each upper prong has a front end, all of which lie approximately in one plane. These features reinforce the above effect further.

Each upper prong has an underside, and each abutment has an upper side that are spaced a short distance from one another. By virtue of these features, the constructional height is further minimized.

Injection molding is used for at least one of the following: the collar, the cap, and the claw. By virtue of these features, simple, cheap and nevertheless dimensionally accurate production is achieved. In addition, injection-molded parts are at least in the majority of cases, tougher and can be used to produce larger-area shapes than is possible, for example, by plate bending.

DESCRIPTION OF THE DRAWINGS

The inventions is now described with reference to a preferred exemplary embodiment. In the drawings:

FIG. 6 shows a view in accordance with arrow 6 in FIG. 4 but shows only the cap and not the canister.

FIG. 8 shows the view of FIG. 6 from below.

It is not necessary to represent the claw separately since it is virtually nowhere obscured by other parts in the above figures.

DESCRIPTION OF A PREFERRED EMBODIMENT

Figure 1:
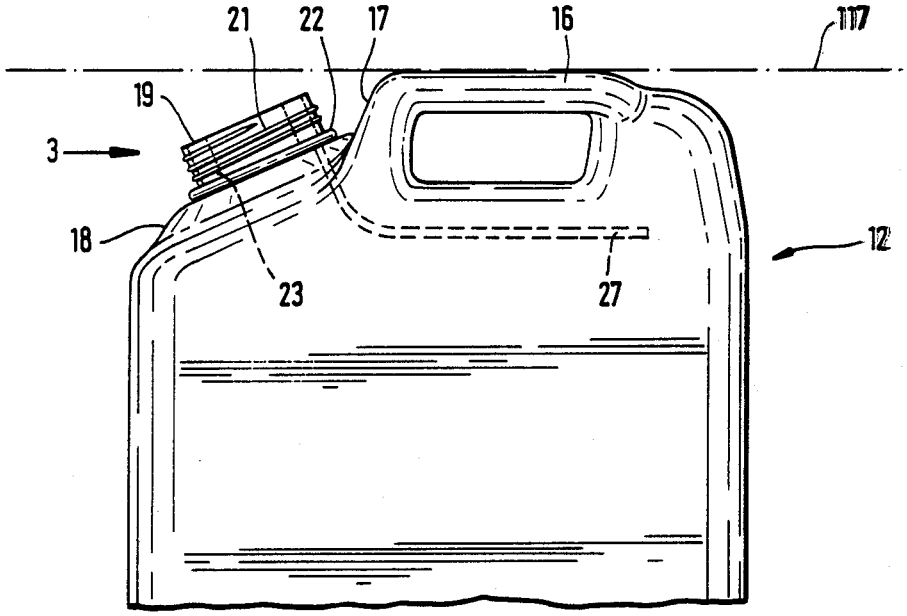
FIG. 1 shows the side view of the upper part of a three-handled canister with the cap unscrewed.
Figure 2:
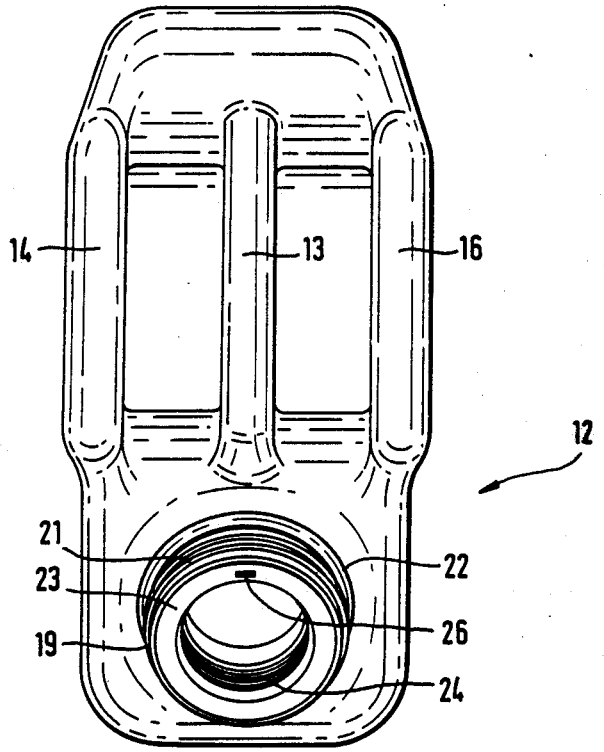
FIG. 2 shows the plan view of FIG. 1.
Figure 3:
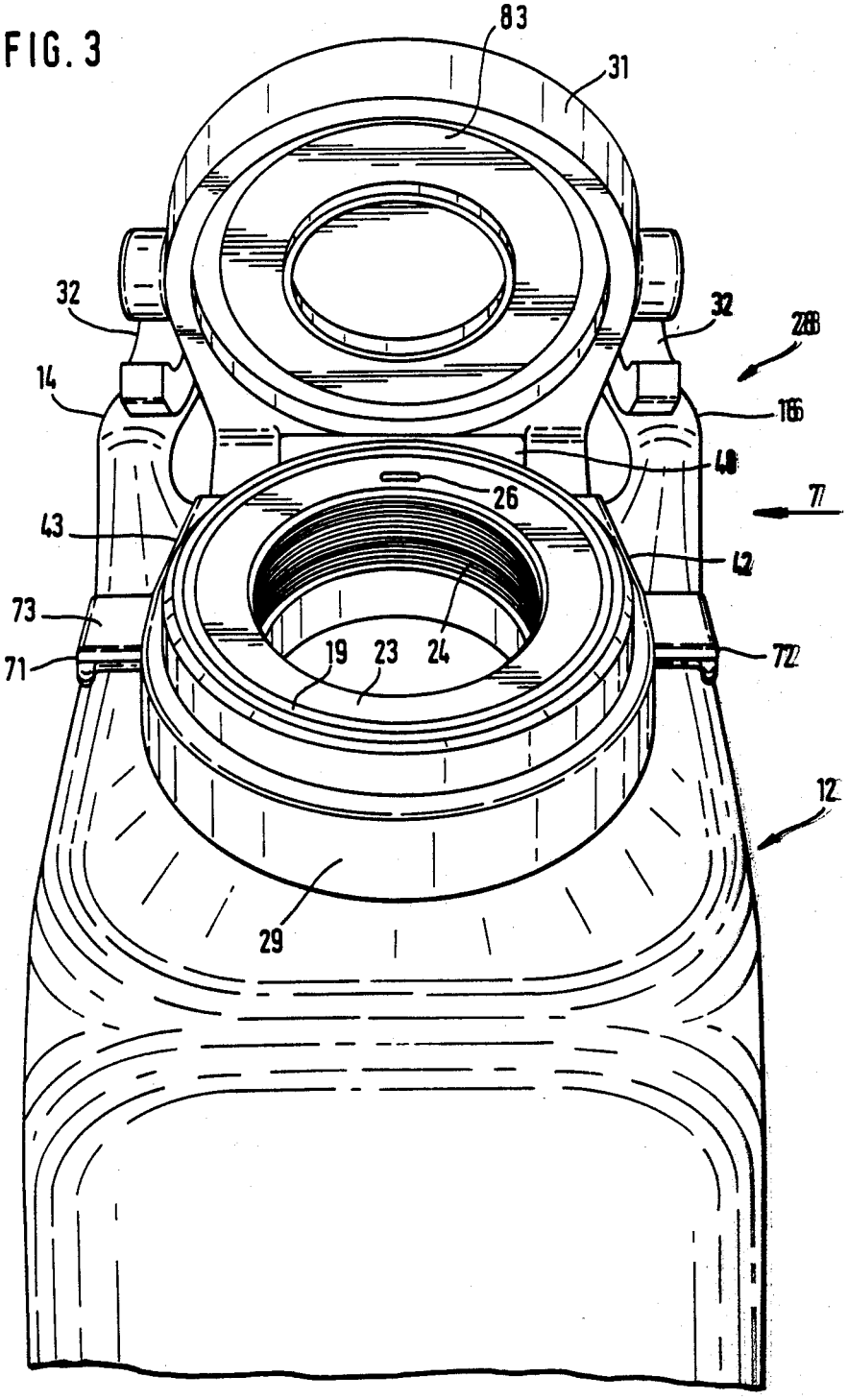
FIG. 3 shows a view in accordance with arrow 3 in FIG. 1 but with the cap open.

Without intending to limit the scope of the claims to the embodiment described, a canister 12 is blow-molded from plastic and has the usual overall dimensions of 20 liter canisters. Its central handle 13 is formed during the blowing operation. The outer handles 14, 16 are inserted into the blow-molded halves as components according to the state of the art, which are injection-molded and are accordingly capable of withstanding greater loads. To the left of the left-hand declivity 17 of the handles, the upper side of the canister 12 merges into an oblique surface 18 which slopes at about 30 degrees, and from which there emanates a pouring nozzle 19 which, according to FIG. 1 points upwards to the left. On its outside, this bears a coarse thread 21 which was produced during the blowing operation. An O-ring 22 is provided in the transitional zone between the pouring nozzle 19 and the oblique surface 18.

Figure 11:
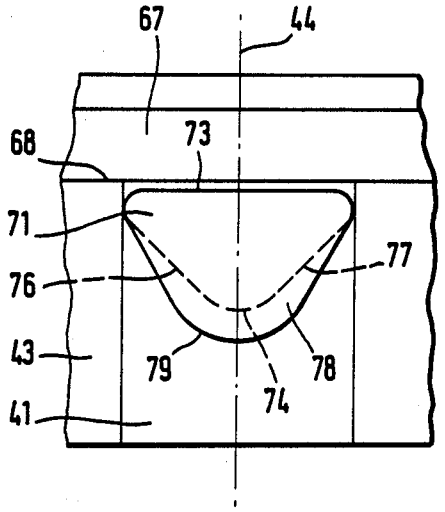
FIG. 11 shows the side view of the abutment with the collar broken off, on a scale of 2:1 compared to FIGS. 9 and 10.
Figure 10:
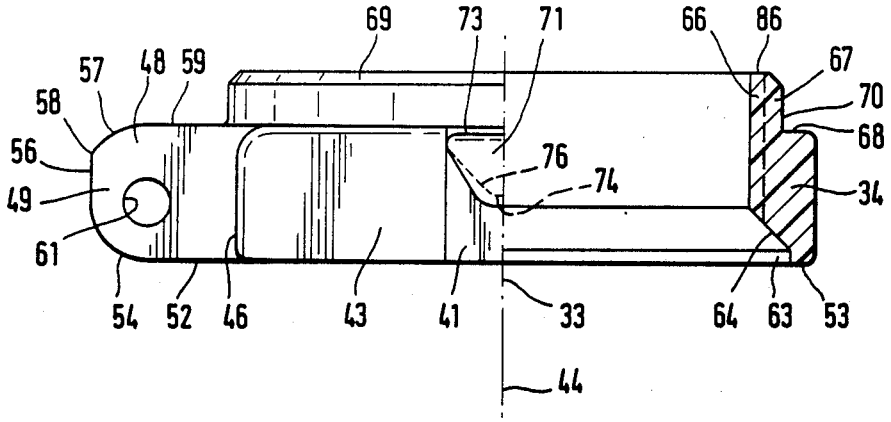
FIG. 10 shows the side view of the collar on its own, partially sectioned.
Figure 10A:
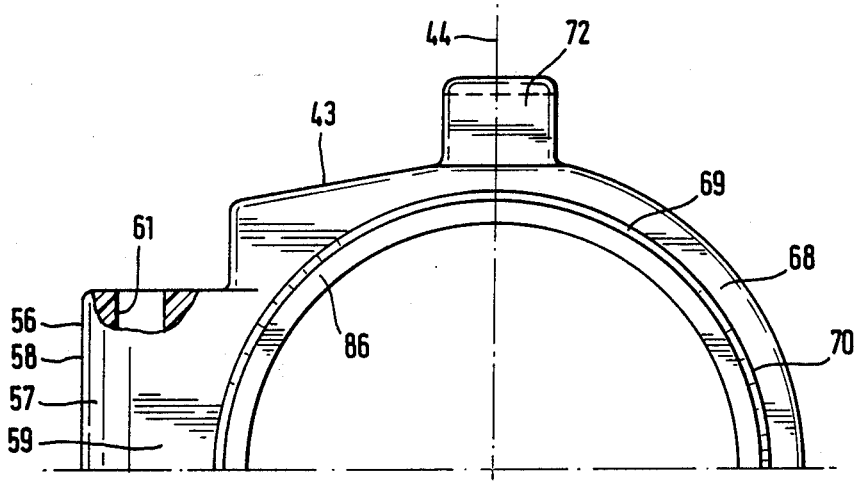
FIG. 10*a* shows a half-top view of the collar shown in FIG. 10.

An insert 23, which has an internal thread 24, has a vent 26 at the top, which continues through to the inside in a manner not shown, and on the inside has a breather tube 27 seated inside the pouring nozzle 19. A closure 28 comprises a collar 29, a cap 31 and a claw 32. All three are injection-molded from glass fiber-reinforced plastic. Over large areas, the collar 29 is coaxial to the geometric longitudinal axis 33. Its body 34 has an outside radius of 53 mm in the region lying to the left of the geometrical longitudinal axis 33 in FIG. 4. The outer surface 36 is coaxial in circular cylindrical manner to the longitudinal axis 33 and, shortly before the abutments 37, 38, changes into a flattened portion 39, 41 which likewise extends over the full height of the body 34. Towards the rear the flattened portions 39, 41 are adjoined by tapering surfaces 42, 43 which extend parallel to the longitudinal axis 33 and in each case taper towards the rear at an angle of 10° as shown in FIGS. 6 and 8. To the inside of the tapering surfaces 42, 43 the wall of the body 34 accordingly becomes thicker. At the rear end of the tapering surfaces 42, 43 these recede inwards by in each case 15 mm parallel to a central plane 44 running through the longitudinal axis 33, giving rise to rear surfaces 46, 47. Centrally between the latter, a hinge block 48 projects backwards for about 25 mm, a part capable of withstanding high loads being the result. On each side, the hinge block 48 is delimited by end surfaces 49, 51 which extend perpendicular to the central plane 44. Its underside 52 extends perpendicular to the central axis 33 and is flush with the lower annular surface 53 of the body 34 both where the latter conforms to the circular shape and in the region to the inside of the tapering surfaces 42, 43. Towards the rear, the underside merges by a radiused portion 54 of 9 mm into a short rear surface 56 which extends parallel to the central plane 44 and rises to a height of 18 mm as seen from the underside 52. There then follows a radiused portion 57 of 12 mm and a distinct edge 58 is thus formed (FIG. 10) against which—as shown below—a region of the cap 31 can rest to prevent it from swinging forwards during pouring. An upperside 59 extends perpendicular to the central plane 44 at a distance of 22 mm from the underside 52. A circular cylindrical through bore 61, the center of which is the center of the radius portion 54, runs through the hinge block 48 perpendicularly to the plane of projection of FIG. 10. The position of the center is evident from FIG. 10. A metal pin 62 (not shown in FIG. 10) which is of one piece and the ending of which is determined by the alignment of the tapering surfaces 42, 43 is held in axially nondisplaceable manner in the through bore. According to FIG. 10, the distance between the center of the through bore 61 and the longitudinal axis 33 is 60 mm. As drawn in FIG. 10, the annular surface 53 is narrow and continues inwards with a 2 mm-high coaxial annular surface 63. A conical surface 64 lying at 45° extends upwards from the latter. This conical surface in turn merges into a trapezoidal thread 66 which is coaxial, of the Tr 88 type and has a pitch of 6.35. The trapezoidal thread 66 also continues on the inside in a coaxial inner rim 67, which has an outer surface 70 which runs rounf in a completely circular-cylindrical manner and lies on a diameter of 93 mm. A supporting ledge 68 which extends perpendicular to the geometric longitudinal axis 33 and is about 5 mm wide is thereby produced on the upper side of the body 34. At the rear, there is a completely flush transition between the supporting ledge 68 and the upper side 59. To the inside of the tapering surfaces 42, 43, the supporting ledge 68 widens, as shown in FIG. 10*a*. The same applies for the upper side 59, where it is likewise flat, of large surface area and always perpendicular to the longitudinal axis 33. At the top and on the outside, the coaxial inner rim 67 has a bezel 69. One abutment 71, 72, which is symmetrical in shape with respect to the central plane 44 in each case projects outwards in the region of the flattened portion 39, 41 just below the supporting ledge 68. Each abutment 71, 72 is essentially as wide as the associated flattened portion 39, 41 and has a flat upper side 73 which runs perpendicular to the longitudinal axis 33. Since both abutments are in mirror-image symmetry, only abutment 71 is described. It has an upper side 73 which extends perpendicular to the central plane 44 and begins just below the supporting ledge 68. It projects about 15 mm outwards and is about 19 mm wide. Abutment 71 is approximately triangular in shape, the tip of the triangle pointing downwards and all angles being rounded. The lower rounded tip 74 is situated approximately half way between the supporting ledge 68 and the annular surface 53 the rounded tip 74 extends outwards for about 11 mm from the flattened portion 41. The triangular shape of the abutment 71 produces a rear stop surface 76 and a front stop surface 77, both of which are symmetrical with respect to the central plane 44. The rounded tip 74 has a radiused portion of 4 mm. A guide rib 78 which points downwards in the manner of a triangle, is a mere 2 mm thick and, according to FIG. 11, projects, in accordance with its profile, beyond the stop surface 76, 77 and the rounded tip 74, is provided at the outside of the abutment 71. At the bottom, the guide rib 68 has a relatively large rounded portion 79 of about 6 mm.

Figure 4:
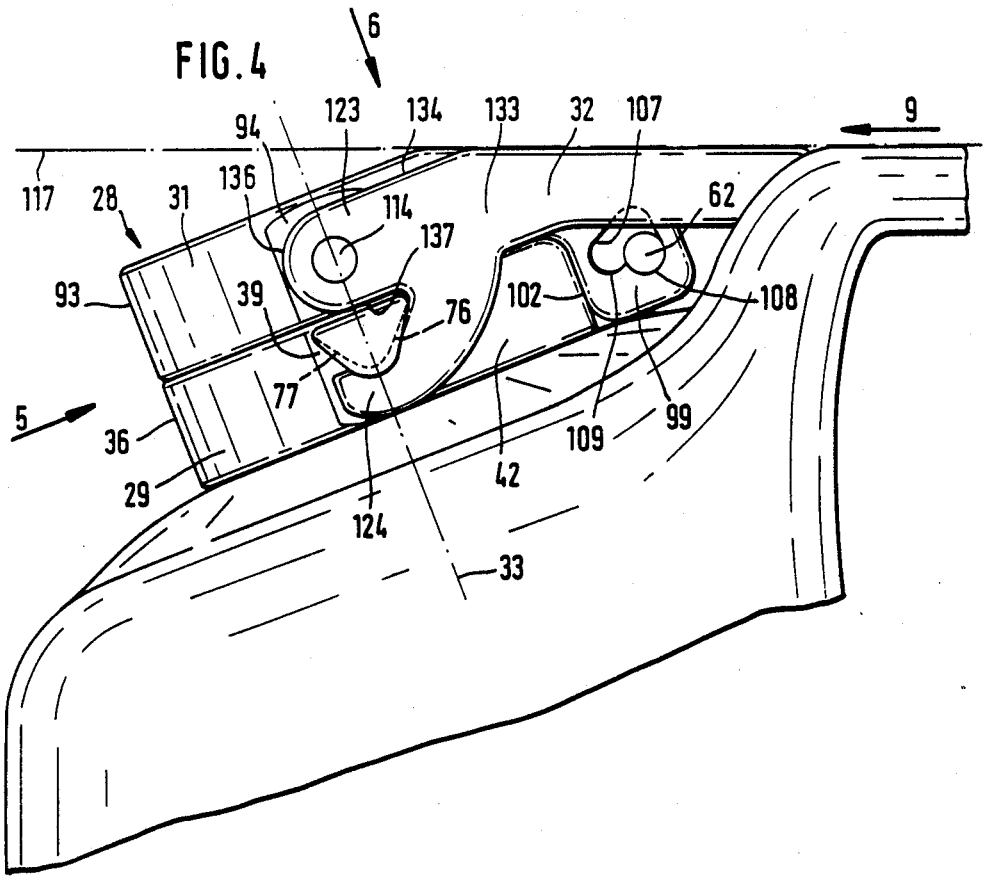
FIG. 4 shows a side view of FIG. 3 but with the cap closed.
Figure 5:
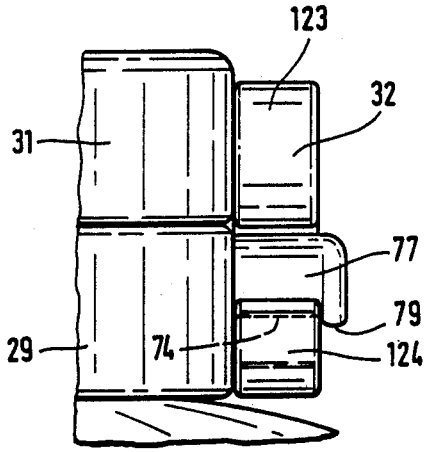
FIG. 5 shows a view in accordance with arrow 5 in FIG. 4 but shows only the right-hand half.
Figure 7:
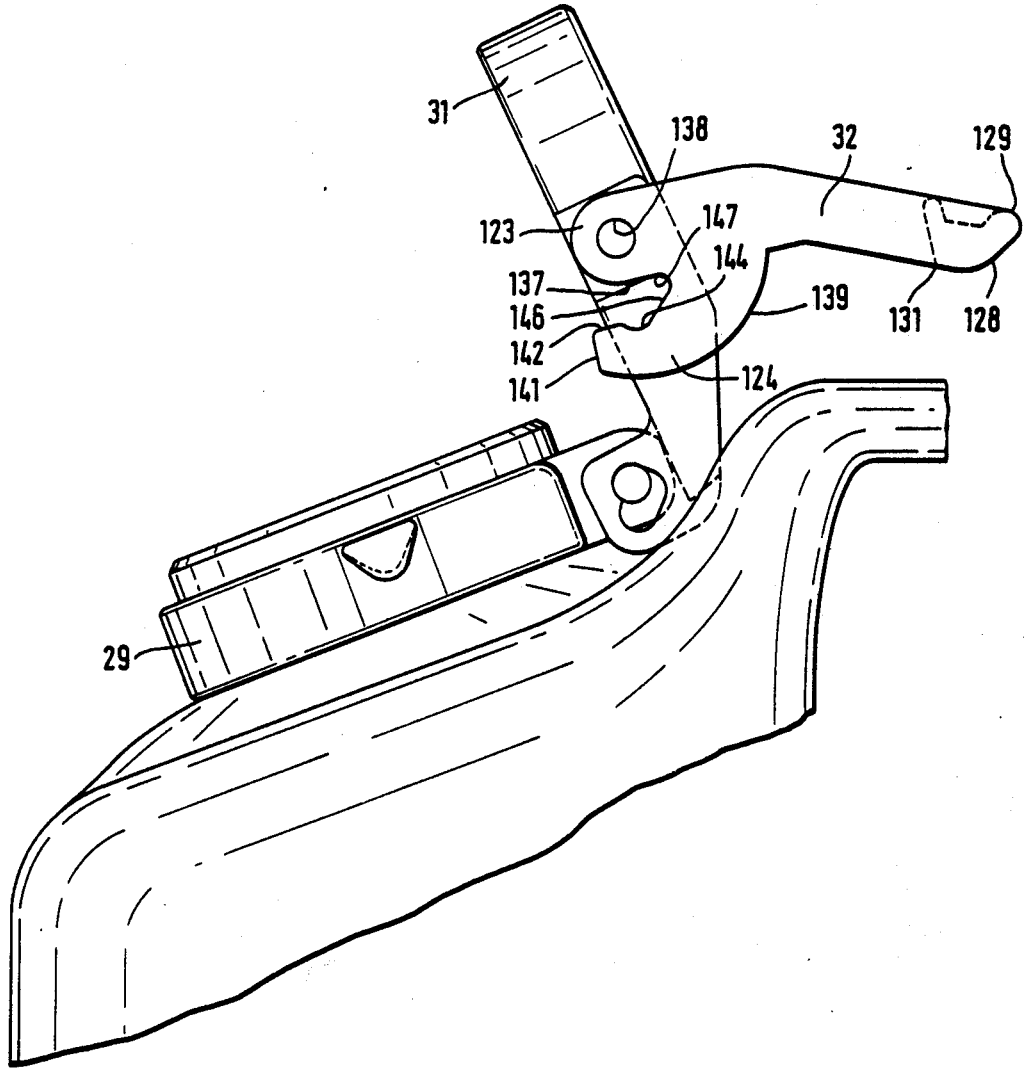
FIG. 7 shows a view in accordance with arrow 7 in FIG. 3.
Figure 9:
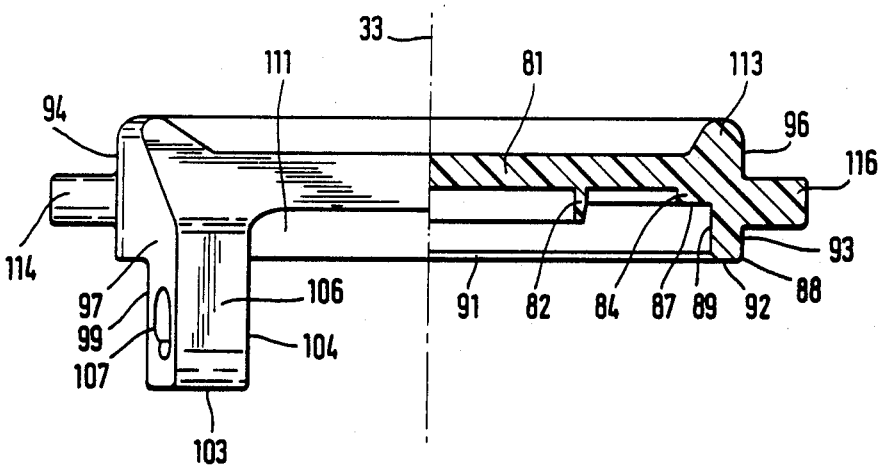
FIG. 9 is a front view of the cap on its own, partially sectioned.

A cap 31 has a cap base 81 which, when the cap is closed, is coaxial to the longitudinal axis 33. Its dimensions can be taken from the 1:1 representation in FIG. 9. A thin rim 82, the outside diameter of which is substantially smaller than the inside diameter of the insert 23, projects coaxially downwards. It bears a sealing ring 83, which fits in sealing manner on the outer end face of the pouring nozzle 19. At its outer periphery, the sealing ring 83 is gripped by the inner surface of a coaxial, downward-projecting step 84. In the closed condition, the step 84 is at no spacing or only a very small spacing from the end face 86 of the coaxial inner rim 67. This means that the underside 87 can act as a compression-limiting surface for the sealing ring 83 and can at the same time also transmit impact forces to the inner rim 67. Outside of the underside, the cap 31 has an outer rim 88, the inner surface 89 of which lies on a diameter which is only slightly greater than the diameter of the outer surface 70 of the coaxial inner rim 67 at the bottom, the inner surface 89 runs into a 45° bezel 91 which, in cooperation with the bezel 69, produces precentering upon closing. Outside the bezel 91, there is an annular surface 92 which lies perpendicular to the longitudinal axis 33 and can receive support on the supporting ledge 68 in the event of overloads. At the front, the outer surface 93 of the outer rim 88 runs coaxial to the axis 33 and is flush with the outer surface 36 of the body 34 in the closed condition, as is shown by FIGS. 4, 6 and 8. Here too, flattened portions 94 and 96, which lie perpendicular to the central plane 44 and, in the view shown in FIG. 6 for example, are in alignement with one another in the closed condition, are provided in a manner corresponding to the outline of the body 34. In a similar manner, the flattened portions 94, 96 merge into tapering surfaces 97, 98 which, in the closed condition, are in alignment with the tapering surfaces 42, 43. From the plane of the annular surface 92 there extend downwards two gudgeons 99, 101. Since both are exact mirror images of one another in shape, only gudgeon 99 is described. Its front surface 102 lies parallel to the central plane 44 and, in the closed condition, virtually lies against the rear surface 46 of the body 34. In the closed condition, its underside 103 lies at the level of the underside 52 of the body 34. Its inner surface 104 lies perpendicular to the central plane 44 and is at only a short spacing from the end surface 49. Its rear surface 106 runs flush with the rear surface 56. There is also a radiused portion corresponding to the radiused portion 54. Because of the position of the inner surface 104 and the planar tapering surface 97 extending into the gudgeon 99, the gudgeon 99 is conically tapered towards the rear, as shown with particular clarity in FIG. 8. The gudgeon 99 has an approximately heart-shaped recess 107, the tip of which points upwards and backwards towards the right according to FIG. 4. In the closed condition, one end of the metal Din 62 lies in the rear indentation 108 which lies at a somewhat lower level according to FIG. 4. When the cap 31 is open, the free end of the metal pin 62 lies in the indentation 109 which, in FIG. 4, is further forward and at a somewhat higher level and, in this state, the edge 58 lies against the annular surface 92 in that region. At the rear, the cap 31 ends with a rear surface 111 arranged between the inner surfaces 104 this surface is not quite perpendicular to the plane of projection of FIG. 6 but slopes forward somewhat. Since it also begins somewhat further forward than the rear surface 56 of the body 34 it enables the hinge block 48 to be seen. The rear surface 111 can come into being because the volume of the cap is drawn rearwards in the region 112 in a manner similar to the hinge block 48. In this region 112, the underside of the cap 31 is at only a very small spacing from the end surface 69, enabling these surfaces too to fit together snugly. Above the outer rim 88 and the step 84, a bead 113 rises above the cap base 81, said bead being 5 mm high, having a radiused portion of 4 mm, being rounded towards the top and its outer surface conforming to the tapered surfaces 97, 98 so that, looking from above in the direction of the longitudinal axis 33, nothing is seen protruding and, in the closed condition, the smooth surface which can be seen in particular in FIG. 4 but also in FIGS. 5, 6, 8 and 9 is produced. Journals 114, 116 which are approximately as long as the rounded tips 74, project beyond the flattened portions 94, 96, being directly above the rounded tip 74 and in the central plane 44 in the closed condition. The center of the journals 114, 116 is approximately at the level of the underside 87 so that in material terms they have towards the top a material bridge to the base/bead region and, in the event of downward bending, are partially linked to this region, as shown to the outside right in FIG. 9.

The upper edge of the outer handles 14, 16 and the central handle 13 define a stacking surface 117. In this plane, the cap 31 has a flattened portion 118, as can be seen particularly clearly from FIG. 6, and since, as seen from the top, the cap 31 has the approximate outline of a horse shoe and the rear surface 111 is set forward, the flattened portion 118 has an approximately H-shaped form as viewed in FIG. 6 wich a broad central region which, within the sidepieces of the H, has been displaced upwards. In the view in FIG. 9, this produces the strange-looking but nevertheless correctly represented perspective view.

The claw 32 comprises a gripping web 119, two lateral webs 121, 122 and in each case an upper prong 123 and a lower prong 124. The gripping web 119 is sufficiently wide to extend on each side far beyond the central handle 13, half way towards the outer handles 14, 16. A gripping depression 126 is molded into it from above. In the closed condition, its upper side 127 lies flush with the stacking surface 117, it thus also lies flush with the flattened portion 118 of the cap 31. With a view to walls of uniform thickness but also to enable the gripping web 119 to be grasped more easily from below and also to be able to exert forces more easily, the gripping web 119 has a downward-directed curvature 128 which, towards the rear, ends with a blunt rounded portion 129. In the closed condition, a longitudinal edge 131 lies on the hinge block 84 approximately in the region of the edge 58 and an extension of this longitudinal edge 131 also lies on the gudgeons 99, 101 or the longitudinal edge 131 is at a very small spacing from the latter. According to FIG. 6, the lateral webs 121, 122 splay out following the angle of the tapering surfaces 97, 98, the angles of which are equal to those of the tapering surfaces 42, 43. Since the lateral webs 21, 22 are exact mirror images of each other, only one of them is described. The inner surface 132, of the lateral web 121 follows closely the tapering surface 98, having a very slight spacing from the latter. As seen from above, both it and its prongs 123, 124 are 11 mm wide and, as seen from the side, 15 mm high. This cross-section is sufficient even when the claw 32 has been injection-molded from plastic. The transition between the lateral web 121 and the upper and lower prongs 123, 124 is formed by a central area 133 which, according to the figures, is broad and inflexible. According to FIG. 4, the upper side 134 of the upper prong 123 runs approximately 4 mm below the bead 113 at that point in the closed condition. To the left, the upper prong 123 ends with a large 10 mm radiused portion 136. The underside 137 of the prong 123 extends on a level with the annular surface 92 of the cap 31. In the upper prong 123, there is a through bore 138 through which the journal 114 passes. The underside 139 of the lower prong rests on a large 30 mm radiused portion which has its center in the center of the through bore 138. In its upper region, the lower pronged 134 and the central area 133 together cover the parting line between the body 34 and the cap 131 in the region lying therebelow. The upper prong 133 and the lower prong 134 have a minimum spacing from the flattened portion 94 and 39 respectively and thus fit close to the latter. The front side 141 runs parallel to the central plane 44 and extends exactly as far forwards as the forward-most point of the radiused portion 136 and of the abutment 37. Perpendicular to the front side 41 and directed inwards there is short planar upper side 142 whose position is such that, during the closure of the claw 32, its forward region fits under the rounded portion 74, at first without the exertion of force, and rests against it. As the claw 32 is moved further towards the closed position, tension is produced which forces the lower prong 124 downwards. During these swivelling movements of the claw 32, the sealing ring 143 is compressed between the front face of the insert 23 and the base 81 of the cap 31.

Inwards of the upper side 142 there is a 2 mm deep locking groove 144, the shape of which corresponds to the rounded tip 74. In the closed condition, this locks into the locking groove 144, the force being determined by the degree to which the sealing ring 83 is compressed.

There follows on from the locking groove 144 an oblique surface 146 which slopes upwards to the right at 45° and, in the closed condition, rests against the stop surface 77 and has a shape which is complimentary to the latter. The oblique surface 146 and the underside 137 meet at a rounded portion 147.

In so far as radiused portions are of no special importance, they are formed by injection molding and have a maximum radius of 3 mm.

As can be understood from the description, but in particular also from FIGS. 4, 5, 6 and 8, a closure 28 has been successfully designed such that, in the critical closed condition, each part supports and protects the other so that randomly occurring impacts and forces are absorbed by a plurality of parts. In addition, care has been taken to ensure that parts do not protrude in a detrimental way since this could lead to the opening of the closure. If the canister 12 falls on the stacking surface 117, the principle forces are absorbed by the handles. The general thinking behind the closure enables the sometimes crude forces to be absorbed even when all the parts have been injection-molded in a plastic. Despite being very convenient to handle, the closure 28 is of flat construction and is relatively broad and long, this being very advantageous under the various operating conditions.

The geometry of the cap 31, claw 32 and abutment 71, 72 also produces another advantageous improvement in functioning: For certain reasons, it may not be possible to open the cap 31, whether it is because, for example, it has stuck or frozen to some degree to the cap 31 or is difficult to open for some other reason (e.g. the external air pressure is too great). In this case, the claw 32 is swivelled by about another 180° out of its unlocked position in the direction of opening. During this operation, the upper side of the upper prong 123 comes to rest on the upper side of the abutments 71, 72 and, if the claw 32 is moved further, the cap 31 opens a crack, this being quite sufficient for pulling it off.

What is claimed is:

1. A closure for a plastic canister in the 20–30 liter range, said canister having integral therewith a plastic pouring spout with an end face, said closure comprising a collar coaxial with said pouring spout, having a rearward periphery and sides having two abutments, said abutments having lower surfaces arranged to cooperate with claws of a claw-type closure, a cap with a sealing ring therein and lateral and rearward edge regions, said cap being arranged to swing between an open condition and a closed condition relative to said collar, a first hinge half projecting from said rearward periphery of said collar, a second hinge half on said rearward edge region of said cap that cooperates with said first hinge half, said first and second hinge halves being shaped to prevent said cap from swinging to said closed condition when said cap is in said open condition, two journals arranged on said lateral edge regions of said cap, and a claw that is approximately U-shaped, seen in plan view, with a transverse gripping web with end regions, and two longitudinal webs emanating from said end regions, each of said longitudinal webs ending at a free end in a fork having an upper and a lower prong as seen in said closed condition of said cap, each of said upper prongs being arranged to form a swivel hinge with said journals, each of said lower prongs having an inner surface arranged to cooperate with said lower surfaces of said abutments such that when said gripping web is pressed downward said sealing ring in said cap is pressed onto said end face of said pouring nozzle, said collar being arranged to fit against said cap with minimal spacings and said claw being arranged to fit against said collar and said cap with minimal spacings, when said cap is in said closed condition, said spacings permitting relative movement of said claw and said cap during opening and closing of said cap, said spacings being smaller than deformations occuring as a result of impact loads on said closure, said claw being composed of plastic.

2. A closure as claimed in claim 1, wherein the length and breadth of said closure in said closed condition are greater than 10 cm.

3. A closure as claimed in claim 2, wherein said breadth is between 10 and 14 cm.

4. A closure as claimed in claim 3, wherein said breadth is in the region of 13 cm.

5. A closure as claimed in claim 2, wherein said length is between 12 and 16 cm.

6. A closure as claimed in claim 5, wherein said length is in the range of 14–15 cm.

7. A closure as claimed in claim 1, wherein plastic is the material of which said collar and said cap are composed.

8. A closure as claimed in claim 7, wherein said plastic is glass fiber-reinforced plastic.

9. A closure as claimed in claim 7, wherein said plastic is glass fiber-reinforced polycarbonate type.

10. A closure as claimed in claim 1, wherein said collar comprises a lower, annular, solid body that firmly surrounds said pouring nozzle, having a coaxial inner rim with an outside diameter that is substantially smaller than the outside diameter of said collar, said inner rim projecting upwards from said body, and a coaxial supporting ledge forming an end face of said body outside said inner rim, and wherein said cap has an outer rim that points downward beyond said sealing ring, with an inside diameter that is slightly greater than said outside diameter of said inner rim of said body.

11. A closure as claimed in claim 10, wherein said inner rim and said outer rim are at least approximately equal in height.

12. A closure as claimed in claim 10, wherein said cap has an upper surface and said outer rim continues as a bead for several millimeters above said upper surface.

13. A closure as claimed in claim 12, wherein said canister has handles with upper sides defining a stacking plane of said canister and said bead does not extend above said stacking plane.

14. A closure as claimed in claim 1, wherein, in the region of said hinge halves, said cap and said collar are approximately as broad as the outer diameter of said pouring nozzle.

15. A closure as claimed in claim 1, wherein said hinge halves comprise two solid gudgeons between which a solid hinge block is located.

16. A closure as claimed in claim 15, wherein said hinge block is provided on said collar.

17. A closure as claimed in claim 16, wherein said hinge block is traversed by a circular, cylindrical pin, the ends of which form a swivel axis for said gudgeons.

18. A closure as claimed in claim 17, wherein said pin is a metal pin.

19. A closure as claimed in claim 15, wherein said collar has a widened region with complimentary recesses for said gudgeons.

20. A closure as claimed in claim 15, wherein, in side elevation and in said closed condition, said gudgeons have at least substantially the same profile as said hinge block.

21. A closure as claimed in claim 15, wherein said cap has a face on said rearward edge region, said hinge block has a rear upper region, each of said gudgeons has an approximately heart-shaped recess with a tip that points upwards, a lower heart chamber and an upper heart chamber, a pin is arrange to lie in said lower heart chamber in said closed condition and in said upper heart chamber in said open condition, and in said open condition said face on said rearward edge region rests against said rear upper region of said hinge block.

22. A closure as claimed in claim 1, wherein said claw and said cap have rear upper sides, and said canister has a stacking plane along said rear upper sides of said claw and said cap.

23. A closure as claimed in claim 22, wherein in said closed condition said gripping web of said claw rests on at least one of said hinge halves.

24. A closure as claimed in claim 1, wherein said canister has a central handle and two outer handles, and said gripping web extends a long way beyond the sides of said central handle towards said outer handles.

25. A closure as claimed in claim 1, wherein said abutments are integral with said collar and comprise prestressed downward-arched portions.

26. A closure as claimed in claim 25, wherein said collar has a supporting ledge, each said abutment has an upper side that lies approximately at the level of said supporting ledge and a lower region on said downward arched portion that lies approximately halfway up said collar body, and said lower prong has a region of engagement with said downward arched portion that is approximately equal in height to the lower half of said collar body.

27. A closure as claimed in claim 1, wherein each said lower prong has an outer surface and each said abutment has an outside with a downward-pointing guide rib for said outer surface of said lower prong.

28. A closure as claimed in claim 1, wherein each said abutment has an arched portion, and each said lower prong has an upper side with a transverse groove into which said arched portion of said abutment locks when said claw is closed.

29. A closure as claimed in claim 28, wherein said arched portion locks deeply.

30. A closure as claimed in claim 28, wherein said transverse groove is spaced below and a short distance from said journal.

31. A closure as claimed in claim 30, wherein said distance is ultra-short.

32. A closure as claimed in claim 1, wherein in said closed condition said lower prong does not protrude beyond said journal.

33. A closure as claimed in claim 1, wherein each said lower prong has a front end, each said abutment has a front edge, and each said upper prong has a front end, all of which lie approximately in one plane.

34. A closure as claimed in claim 1, wherein each said upper prong has an underside and each said abutment has an upper side that are spaced a short distance from one another.

35. A closure as claimed in claim 7, wherein injection molding is used for said collar, said cap, and said claw.

36. A closure as claimed in claim 7, wherein said plastic is of the Zytel type (registered trademark of the DuPont Company).

37. A closure as claimed in claim 7, wherein said plastic is of the Rynite type (registered trademark of the DuPont Company).

38. A closure for a plastic canister in the 20–30 liter range, said canister having integral therewith a plastic pouring spout with an end face, said closure comprising a collar coaxial with said pouring spout, having a rearward periphery and sides having two abutments, said abutments having lower surfaces arranged to cooperate with claws of a claw-type closure, a cap with a sealing ring therein and lateral and rearward edge regions, said cap being arranged to swing between an open condition and a closed condition relative to said collar, a first hinge half projecting from said rearward periphery of said collar, a second hinge half on said rearward edge region of said cap that cooperates with said first hinge half, said first and second hinge halves being shaped to prevent said cap from swinging to said closed condition when said cap is in said open condition, two journals arranged on said lateral edge regions of said cap, and a claw that is approximately U-shaped, seen in plan view, with a transverse gripping web with end regions, and two longitudinal webs emanating from said end regions, each of said longitudinal webs ending at a free end in a fork having an upper and a lower prong as seen in said closed condition of said cap, each of said upper prongs being arranged to form a swivel hinge with said journals, each of said lower prongs having an inner surface arranged to cooperate with said lower surfaces of said abutments such that when said gripping web is pressed downward said sealing ring in said cap is pressed onto said end face of said pouring nozzle, said collar being arranged to fit against said cap with minimal spacings and said claw being arranged to fit against said collar and said cap with minimal spacings, when said cap is in said closed condition, said spacings permitting relative movement of said claw and said cap during opening and closing of said cap, said spacings being smaller than deformations occurring as a result of impact loads on said closure, said claw and said cap having rear upper sides, said canister having a stacking plane along said rear upper sides of said claw and said cap, and in said closed condition said gripping web of said claw rests on at least one of said hinge halves.

* * * * *